US005543619A

United States Patent [19]

Mullock

[11] Patent Number: 5,543,619

[45] Date of Patent: Aug. 6, 1996

[54] VACUUM INLET

[75] Inventor: Stephen J. Mullock, Cambridge, United Kingdom

[73] Assignee: Kore Technology Limited, Cambridge, United Kingdom

[21] Appl. No.: 346,202

[22] Filed: Nov. 22, 1994

[30] Foreign Application Priority Data

Nov. 25, 1993 [GB] United Kingdom ..... 9324213

[51] Int. Cl.[6] ..... H01J 49/36

[52] U.S. Cl. ..... 250/288; 250/289; 250/282; 250/281

[58] Field of Search ..... 250/288, 289, 250/281, 282

[56] References Cited

U.S. PATENT DOCUMENTS

| | | | |
|---|---|---|---|
| 3,801,788 | 4/1974 | Milne | 250/288 |
| 4,740,692 | 4/1988 | Yamamoto | 250/288 |
| 4,888,482 | 12/1989 | Kato | 250/288 |
| 4,955,717 | 9/1990 | Henderson | 250/288 |
| 5,049,739 | 9/1991 | Okamoto | 250/281 |
| 5,308,977 | 5/1994 | Oishi et al. | 250/288 |
| 5,316,955 | 5/1994 | Govorchin | 250/288 |
| 5,382,794 | 1/1995 | Downey et al. | 250/288 |

FOREIGN PATENT DOCUMENTS

0532046A1 3/1993 European Pat. Off. .

OTHER PUBLICATIONS

Olivares & Houk, Ion Sampling for Inductively Coupled Plasma Mass Spectrometry, 1985, Anal. Chem., 57, 2674–2679.

Chambers et al., Fundamental Studies of the Sampling Process . . . Spectrometer, Spectrochimica Acta, vo. 46, No. 6/7, pp. 741–746, 1991.

McGraw–Hil, Encyclopedia of Science & Technology, 1977, Q121.M3, pp. 206–207.

McGraw–Hill, Handbook of Physics, 1958, Chapter 6, Vacuum Technique, pp. 5—78–5–81.

*Primary Examiner*—Jack I. Berman
*Assistant Examiner*—Kiet T. Nguyen
*Attorney, Agent, or Firm*—Watson, Cole, Grindle & Watson

[57] ABSTRACT

A sample inlet apparatus comprises a sample source (1) and a first enclosure (3), connected to the sample source via a first inlet (2). An analyser enclosure (7) is connected to the first enclosure (3) via a second inlet (5,15) substantially in alignment with the first inlet (2). Also provided is a second enclosure (10), connected to the analyser enclosure (7) via a third inlet (9) substantially in alignment with the first (2) and second (5,15) inlet, and vacuum pumps (4,11) for maintaining the first (3) and second enclosures (10) at a pressure lower than the sample source (1) and higher than that of the analyser enclosure (7) in use, whereby a molecular beam of sample molecules is generated along the axis of the inlet.

27 Claims, 1 Drawing Sheet

VACUUM INLET

BACKGROUND OF THE INVENTION

This invention relates to the interfacing of a gaseous source of sample material to an analyzer that requires a vacuum to operate.

Some analytical instruments require a high vacuum for successful operation, for example mass spectrometers. At the same time it is sometimes necessary to admit a certain amount of a gaseous sample for analysis from a high pressure region, often at atmospheric pressure. Any such inlet material needs to be pumped away by the high vacuum pump in order to maintain the vacuum required by the analyser. It is a feature of most vacuum pumps that they pump at a roughly constant volume flow rate and that the higher the flow rate required the more expensive the pump. This implies that a given mass flow rate is more expensive to pump away if the pressure at which the pump is operating is lower. For example, a vacuum pump operating at $10^{-5}$ mbar would have to have 10 times the volume rate capacity of a pump operating at $10^{-4}$ mbar in order to achieve the same mass flow rate.

In principle sample gas could be admitted from the high pressure source to the vacuum system through a single very small aperture with a single high vacuum pump operating at the pressure of the analyser. Such a leak would however have to be very small indeed and therefore difficult to interface to the source of analytical material. For example, suppose that the available pump capacity is 400 liter/sec (say a turbo-molecular pump weighing 20 pounds and costing some £4000), the analyser requires to be at $10^{-5}$ mbar to operate successfully and the inlet is an aperture from atmospheric pressure straight into the vacuum. The effective pumping speed at atmospheric pressure is approximately 400 liter/sec÷$10^8$, the pressure ratio, which equals 4 μliter/sec. A thin aperture from atmosphere to vacuum allows a volume flow rate of 200× A $m^3$/sec where A is the cross sectional area of the aperture in square meters. This implies an aperture area of 20 $\mu m^2$, or an aperture diameter of ~5 μm. Difficulties would arise because of the tendency of the leak to block, particularly if there are condensable components in the analytical stream. There may also be other reasons why the sampling aperture may not be this small. For example, in the particular case of sampling from an inductively coupled plasma, the sampling aperture must be larger than the plasma boundary layer in order to sample the plasma effectively (see J. A. Olivares and R. S. Houk, Anal. Chem. 57 p2674, 1985) leading to an aperture typically 0.5 to 1 mm. Often the pressure is reduced from atmospheric to the spectrometer operating pressure in more than one stage, such a system usually being referred to as a differential pumping system. Between each stage there is a small aperture, 0.1 to 1 mm in diameter, which separates a higher pressure region from a lower pressure region and each stage has its own pump. Typically the first vacuum stage is pumped with a rotary pump to 1 to 10 mbar, the second stage is pumped with a diffusion pump or turbo molecular pump to $10^{-4}$ to $10^{-3}$ mbar and the third stage is pumped with a high vacuum pump to $\mathbf{10^{-6}}$ to $\mathbf{10^{-5}}$ mbar. This way the bulk of the sample admitted is pumped away at relatively high pressures thus keeping down the capacity of the pumps used. Of course the consequence is that only a very small portion of the sample admitted through the first aperture actually travels all the way into the analyser space.

U.S. Pat. No. 3801788 discloses a method and apparatus for mass marking in mass spectrometry which provides molecule clusters at regular mass intervals over a mass range. U.S. Pat. No. 5049739 discloses a plasma ion source mass spectrometer with resonance charge exchange reaction and ion energy analysing sections which separate fast neutral atoms and slow disturbing ions. EP-A-0532046 discloses a vacuum device for a mass spectrometer with atmospheric pressure ionisation.

It is the object of the present invention to increase the proportion of the sample available to the analyser whilst at the same reducing the capacity and hence cost of the pumping required.

SUMMARY OF THE INVENTION

According to the present invention there is provided, a sample inlet apparatus comprising:

a sample source;

a first enclosure, connected to the sample source via a first inlet means;

an analyser enclosure, connected to the first enclosure via a second inlet means substantially in alignment with the first inlet means;

a second enclosure, connected to the analyser enclosure via a third inlet means substantially in alignment with the first and second inlet means; and means for maintaining the first and second enclosures at a pressure lower than the sample source and higher than that of the analyser enclosure in use, whereby a molecular beam of sample molecules is generated along the axis of the inlet means alignment.

Preferably, the second inlet means comprises a single inlet, the third inlet means also comprises a single inlet, and the ratio of the distances between the two single inlets and the first inlet means is substantially the same as the ratio of their diameters, although the second inlet means may comprise two aligned inlets, the first inlet connecting the first enclosure to the second enclosure and the second inlet connecting the second enclosure to the analyser enclosure.

Alternatively, the apparatus may comprise a third enclosure, the pressure maintaining means maintaining the third enclosure at a pressure lower than the first enclosure and higher than the analyser enclosure, the second inlet means comprising two aligned inlets, the first inlet connecting the first enclosure to the third enclosure, and the second inlet connecting the third enclosure to the analyser enclosure, the third inlet means may then comprise a single inlet, with the ratio of the distances between the third inlet means and the first inlet means and between the second inlet of the second inlet means and the first inlet means and the ratio of their diameters being substantially the same.

Preferably, the sample source includes means for atmospheric pressure ionisation so that the molecular beam includes a proportion of ions. There may also be provided means for extracting ions from the molecular beam within the analyser chamber, and means for ionisation can be provided within the analyser enclosure. The analyser chamber may also contain a time-of-flight mass spectrometer.

According to the present invention there is also provided a method of supplying a sample of molecules or ions to an analyser enclosure under vacuum, the method comprising the steps of:

forming a molecular beam which includes the sample and in which the density of molecules is at least an order of magnitude higher than the density of molecules in the background vacuum of the analyser enclosure;

directing the molecular beam across the analyser enclosure and through an aperture into a pumping enclosure where the background pressure is higher but nevertheless a vacuum exists sufficient that the mean free path of the background gas molecules is significantly greater than a dimension of the aperture, the aperture being placed and being of such dimensions so as to allow free passage of the bulk of the molecular beam whilst at the same time being sufficiently small that, notwithstanding the pressure being higher in the pumping enclosure than in the analyser enclosure, the mass flow rate of gas backstreaming from the pumping enclosure to the analyer enclosure through the aperture is substantially less than the mass flow rate of the portion of the molecular beam passed through the aperture in the opposite direction.

Preferably, the sample is at first supplied to a first enclosure at low pressure with the flow into the first enclosure occurring as a supersonic expansion, the molecular beam being formed by an aperture positioned within the supersonic expansion. The molecular beam may be formed by passing sample molecules through a tube, the length of the tube being much greater than its diameter, the diameter being smaller than the mean free path of sample molecules in the tube.

Preferably, the sample molecules are partially ionised by atmospheric pressure ionisation prior to passing through the first inlet means, although the molecular beam may be ionised within the analyser enclosure, where the ions may be extracted from the molecular beam within the analyser enclosure.

The main principle of the invention is to create a directed molecular beam from the source gas and pass it through the vacuum region that contains the analyser, with minimal scattering, directly through a differential pumping aperture into a pumping region at a higher pressure. As in the conventional method of differentially pumped sources, the bulk of the sample is pumped at pressures higher than the background pressure in the analyser region. However in the case of an inlet which uses the present invention, source material passes through the analyser space, with the lowest background pressure, before entering a higher pressure region where most of it is pumped away. With this reversed differential pumping method much more of the source material is available in the analyser region than would be the case if all the higher pressure pumping had taken place first. The creation of a molecular beam is required because it is necessary for the net mass flow of gas from the analyser region to a pumping region to be positive even though the background gas pressures are such so as to cause gas to flow in the other direction. The molecular beam consists of many molecules travelling essentially in the same direction in the form of a slowly spreading beam with little interaction between molecules in the beam. The density of molecules in the beam may be very much higher than the density in the surrounding background vacuum and therefore an aperture placed in the path of the beam passes a high mass flow rate. The mass flow rate due to a difference in background pressures may be very much lower because the average molecular density is lower and the molecules are travelling in random directions.

A well known method for forming a molecular beam is via a supersonic expansion of gas at high pressure into a low pressure region through a small aperture (see D. M. Chambers, J. Poehlman, P. Yang, and G. M. Heiftje, Spectrochemical Acta. 46 p741 1991). Near this first aperture there is lots of scattering between molecules and somewhat further away from the aperture a shock wave forms where the incoming source gas interacts with the background gas molecules. In between these two regions there is a region of molecular flow, consisting still almost entirely of the incoming source gas, but with molecules no longer scattering one another. A second aperture, usually called a skimmer, placed in this region and leading to a higher vacuum region, extracts a molecular beam.

A second, method of creating a molecular beam is to allow gas to pass through a long thin tube at a pressure where the mean free path is very much greater than the diameter of the tube. Gas molecules emerging from the output of the tube are much more likely to have velocities parallel to the tube than at other angles, leading to a directed molecular beam.

Although the beam in question is referred to as a molecular beam, it may contain a proportion of ionic species. Indeed, where the analyzer is a mass spectrometer using a high pressure (for example atmospheric pressure) ionisation source, the whole purpose of the inlet system may be to transport as high a proportion of ions into the analyser space as possible. The principle of the invention still applies providing the mass flow in the analyser space is still largely directed in a beam that can be intercepted with a pumping aperture. In this case the ionic species of interest would be pulled out of the beam by electric or magnetic fields to be passed to the mass spectrometer whilst the bulk of the molecular beam passes on through the pumping aperture.

Similarly, ionic species may be created in the beam once inside the analyser vacuum space and then extracted into the analyser leaving the neutral species to pass on to the pumping stage. The ionisation means might itself require a good vacuum, for example electron impact ionisation or far ultra violet photoionisation. The reversed differential pumping arrangement according to this invention makes much more neutral material available to the ionisation source, thus leading to greater sensitivity for a given pumping capacity.

BRIEF DESCRIPTION OF THE DRAWINGS

A specific embodiment of the invention will now be described by way of example with reference to the accompanying drawings in which.

DETAILED DESCRIPTION OF THE INVENTION

Figure 1:
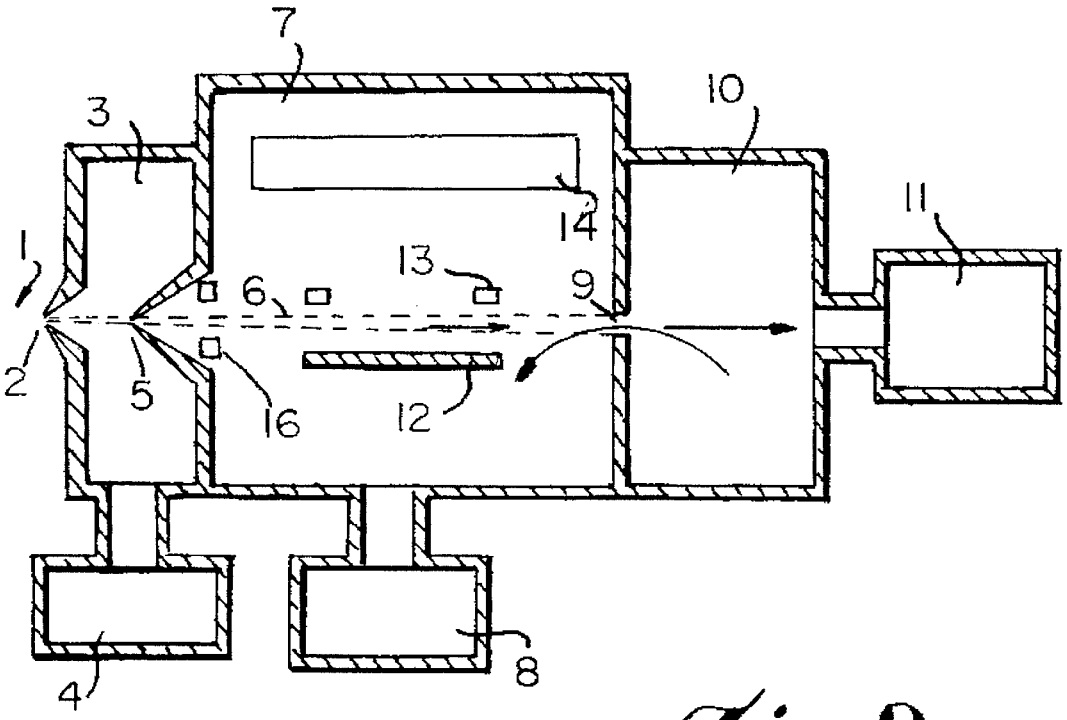
FIG. 1 shows, in schematic form, an arrangement, according to the invention for an inlet from an inductively coupled plasma to a mass spectrometer; and, FIG. 2 shows, in schematic form, an alternative arrangement according to the invention.

The basic construction of apertures for sampling from an inductively coupled plasma is known. Otherwise the system consists of standard vacuum parts arranged according to the invention. Referring to FIG. 1 the source of sample gas is an inductively coupled argon plasma flame 1. Gas enters the first vacuum space 3 via a water cooled nickel aperture 2 of approximately 1 mm diameter. The first vacuum stage 3 is pumped by a rotary pump 4 to a background pressure of approximately 4 mbar. Assuming that the plasma temperature is around 5000 K. the flow rate through the first aperture 2 is approximately $10^{21}$ atoms/sec. A second skimming aperture 5 of diameter 0.3 mm is placed 10 mm behind the first aperture in the molecular flow region of the expansion creating a molecular beam 6 that passes into the second vacuum stage 7. The molecular beam has a virtual origin approximately at the first aperture and so approximately $10^{18}$ atoms/sec pass through the vacuum space 7 and the approximate diameter of the beam at various points downstream of aperture 5 is given by the diameter of skimmer aperture 5 multiplied by the distance at a particular point downstream from the first aperture 2 divided by the spacing between the first two apertures 2 and 5. Thus to include the whole beam a further aperture 9 placed 60 mm from aperture 2 needs to be approximately 2 mm in diameter. Aperture 9 leads to a further vacuum stage 10 pumped by a high vacuum pump 11 to a pressure of approximately $10^{-3}$ mbar. The second vacuum region 7 is also pumped by a high vacuum pump 8. This is required to remove gas that backstreams from the higher pressure region 10 through the aperture 9. Electrostatic ion extraction electrodes 12 and 13 are placed either side of the beam to direct ions contained within the molecular beam towards a mass spectrometer 14. The bulk of the beam is unaffected by the extraction electrodes as ions represent only about 0.1% of the beam extracted from an inductively coupled plasma. An ionization device 16, which may be any one of several known devices, for example, a hot filament or ionization electrode may be provided in the sample chamber 7 to ionize the beam 6.

The capacity of the two high vacuum pumps 8 and 11 can now be calculated. The background vacuum gas in each vacuum region is at room temperature having undergone collisions with the vacuum system walls and the density is given by:

$$d=N_A P/RT \text{ atoms/m}^3$$

where $N_A$ is Avagadro's number, P is the pressure in Pascals, T the temperature in Kelvin and R the gas constant (8.314 J $K^{-1}$ $mol^{-1}$). At $10^{-3}$ mbar $d=2.4\times10^{19}$ atoms/$m^3$ and at $10^{-5}$ mbar $d=2.4\times10^{17}$ atoms/$m^3$ The pump capacity required for a given vacuum region is simply:

$$C=1000\ U/d \text{ liters/sec}$$

where U is the rate at which gas enters the region in atoms/sec. So the vacuum pump 11 needs a capacity of approximately 40 liter/sec to pump away the $10^{18}$ atoms/sec in the molecular beam entering the pumping enclosure 10. The backstreaming flow of background gas into the spectrometer chamber 7 can be derived from the following well known formula for flow through a thin aperture from a high pressure to a much lower pressure when the mean free path is greater than the aperture diameter, which in the case of a circular aperture is the characteristic cross-sectional dimension:

$$Ca=A(RT/2\pi M)\text{m}^3/\text{sec}$$

where A is the aperture area and M is the molar mass in Kg/$mol^{-1}$. For argon at room temperature through a 2 mm diameter aperture this works out at 0.31 liters/sec. The pump capacity of the high vacuum pump 8 must be 100 times this (i.e. 31 liters/sec) as it pumps at $10^{-5}$ mbar whereas the leak rate just calculated is at $10^{-3}$ mbar, the pressure in the pumping chamber 10.

In summary the inlet system requires one large rotary pump 4, whose capacity would be the same as an inlet using the conventional differential pumping and, for example, two small (50 liter/see) turbomolecular pumps. With this reasonably modest pumping requirement $10^{18}$ atoms/sec of the plasma are available to the mass spectrometer. In a conventional differential pumping arrangement all the sample gas made available to the spectrometer has to be pumped away at the spectrometer background pressure. If the same $10^{18}$ atoms/sec were pumped away at $10^{-5}$ mbar it would require a pump with a capacity of 4000 liters/sec i.e. some two orders of magnitude greater in size. If turbo molecular pumps were preferred then this would be an inconveniently large size and a compromise would be probably made of $10^{17}$ atoms/sec and a 400 liter/sec pump. So it can be seen that the invention can provide a system that is both more sensitive and less expensive.

Although sampling from an inductively coupled plasma is cited as an example it will be appreciated by those skilled in the art that various other analytical instruments could benefit from a reversed differential pumping arrangement. Several ionisation methods are currently used that already employ a supersonic expansion of gas. Examples include thermospray, plasmaspray, electrospray and corona discharge atmospheric ionisation sources. Where, as in these cases, the analyser is a mass spectrometer, ionisation could also be by electron impact with the molecular beam in the analyser stage or by photoionisation either in the analyser stage or upstream from it. Often these ion sources are used in conjunction with primary sample separation techniques such as liquid chromatography, gas chromatography or capillary electrophoresis that are normally benchtop instruments. A reduced pumping requirement for the mass spectrometer would be an important advantage.

Although the sources mentioned are basically gaseous in nature where they enter the vacuum inlet, the components being analysed may be non-volatile. Indeed it will often be the case that the analyte is entrained in a buffer gas. It partly for this very reason that excessively small apertures have a tendency to become blocked. Providing the analyte can be carried in a molecular beam the present invention may provide advantages.

Figure 2:
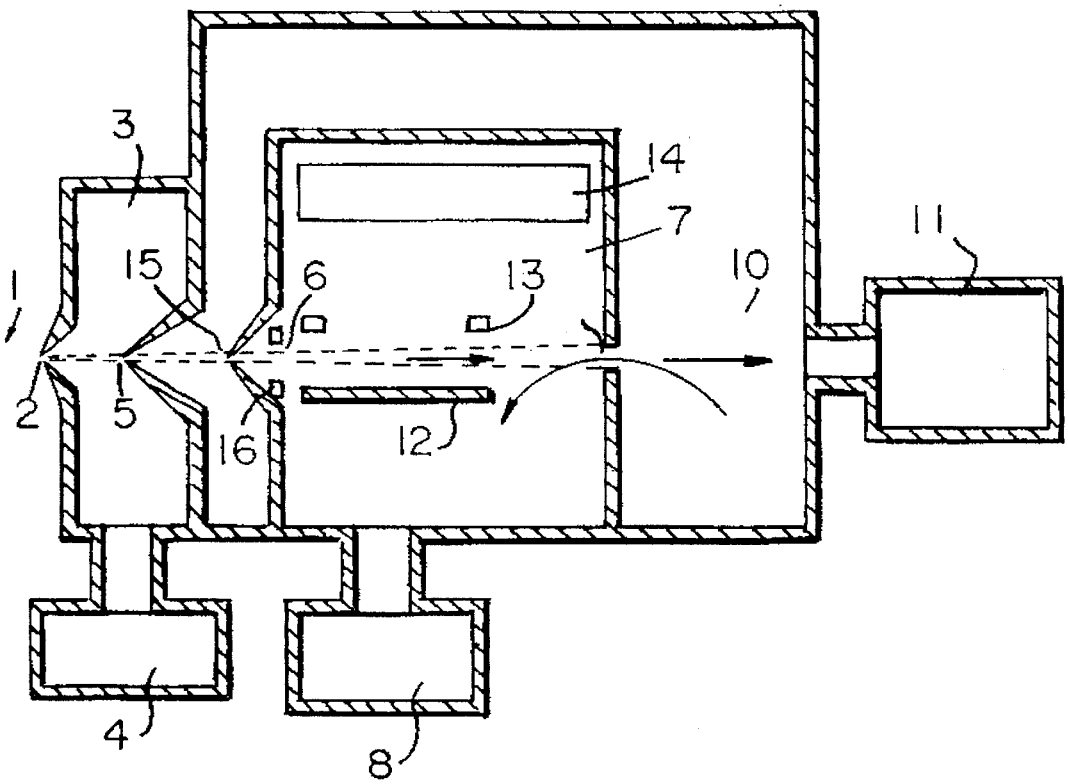

The arrangement depicted in FIG. 1 is a relatively simple one. It will be appreciated by those skilled in the art that other arrangements are possible that follow the same basic principle. For example FIG. 2 shows an alternative arrangement wherein the pumping enclosure 10 pumps some of the gas before the molecular beam enters the analyser enclosure 7 as well as after the aperture 9. In this case a further aperture 15 has been added. Such an arrangement does not require a further pump and may allow more suitable aperture sizes to be used in some applications. It will be appreciated that the enclosure 10 of FIG. 2 could be replaced by two separate enclosures, one either side of the analyser enclosure 7.

It is a general feature of the geometry suggested that the spectrometer does not lie on the axis of the molecular beam. With some analyzers this may be a disadvantage, however if the analyser is a time-of-flight mass spectrometer then it is preferred to extract the ions at right angles to the molecular beam to minimise velocity spread in the direction of flight in the spectrometer. The invention is thus particularly well suited to the business of interfacing atmospheric pressure ion sources to a time-of-flight mass spectrometer.

I claim:

1. A sample inlet apparatus comprising:

a sample source;

a first inlet means;

a first enclosure, connected to said sample source via said first inlet means;

a second inlet means substantially in alignment with said first inlet means;

an analyser enclosure, connected to said first enclosure via said second inlet means;

a third inlet means substantially in alignment with said first and said second inlet means;

a second enclosure, connected to said analyser enclosure via said third inlet means; and means for maintaining said first and said second enclosures at a pressure lower than said sample source and higher than that of said analyser enclosure, whereby a molecular beam of sample molecules is generated along an axis defined by the alignment of said first inlet means said second inlet means and said third inlet means.

2. The apparatus of claim 1, wherein said second inlet means comprises a corresponding single inlet aperture having a selected diameter, said third inlet means comprises a corresponding single inlet aperture having a selected diameter, and wherein each of said single apertures is separated from the first inlet means by a corresponding selected distance, wherein the ratio of the distances between each of said single inlet apertures and said first inlet means is substantially the same as the ratio of the respective diameters of said apertures.

3. The apparatus of claim 2, wherein said sample source includes means for atmospheric pressure ionisation so that said molecular beam includes a proportion of ions.

4. The apparatus of claim 2, wherein there is further provided means for extracting ions from said molecular beam within said analyser chamber.

5. The apparatus of claim 2, wherein said apparatus includes a time-of-flight spectrometer in communication with said analyser enclosure for sampling said molecular beam.

6. The apparatus of claim 1, wherein said second inlet means comprises a first inlet aperture and a second inlet aperture aligned therewith, the first inlet aperture connecting said first enclosure to said second enclosure and said second inlet aperture connecting said second enclosure to said analyser enclosure.

7. The apparatus of claim 6, wherein said third inlet means comprises a corresponding single inlet aperture having a selected diameter, and being separated from the first inlet means by a corresponding selected distance, wherein the ratio of the distances between said third inlet aperture and said first inlet means and between said second inlet aperture of said second inlet means is substantially the same as the ratio of the respective diameters of said apertures.

8. The apparatus of claim 6, wherein said sample source includes means for atmospheric pressure ionisation so that said molecular beam includes a proportion of ions.

9. The apparatus of claim 6, wherein there is further provided means for extracting ions form said molecular beam within said analyser chamber.

10. The apparatus of claim 6, wherein said apparatus includes a time-of-flight spectrometer in communication with said analyser enclosure for sampling said molecular beam.

11. The apparatus of claim 1, further comprising a third enclosure, and a further pressure maintaining means for maintaining said third enclosure at a pressure lower than said first enclosure and higher than said analyser enclosure, said second inlet means comprising a first inlet aperture and a second inlet aperture aligned therewith, said first inlet aperture connecting said first enclosure to said third enclosure, and said second inlet aperture connecting said third enclosure to said analyser enclosure.

12. The apparatus of claim 11, wherein said third inlet means comprises a corresponding single inlet aperture having a selected diameter, and being separated from the first inlet means by a corresponding selected distance, wherein the ratio of the distances between said third inlet means and said first inlet means and between said second inlet aperture of said second inlet means is substantially the same as the ratio of the respective diameters of said apertures.

13. The apparatus of claim 11, wherein said sample source includes means for atmospheric pressure ionisation so that said molecular beam includes a proportion of ions.

14. The apparatus of claim 11, wherein said apparatus includes a time-of-flight spectrometer in communication with said analyser enclosure for sampling said molecular beam.

15. The apparatus of claim 1, wherein said sample source includes means for atmospheric pressure ionisation so that said molecular beam includes a proportion of ions.

16. The apparatus of claim 15, wherein said analyser chamber contains a mass spectrometer.

17. The apparatus of claim 1, wherein there is further provided means for extracting ions from said molecular beam within said analyser chamber.

18. The apparatus of claim 1, wherein means for ionisation is provided within said analyser enclosure.

19. The apparatus of claim 1, wherein said apparatus includes a time-of-flight spectrometer in communication with said analyser enclosure for sampling said molecular beam.

20. A method of supplying a sample of molecules or ions to an analyser enclosure under vacuum containing background molecules having a selected density and corresponding mean free path, the method comprising the steps of:

forming a molecular beam which includes said sample having a density and in which the density of said sample molecules is at least an order of magnitude higher than the density of background molecules in the vacuum of said analyser enclosure; and directing the molecular beam across said analyser enclosure through an aperture having a selected cross-sectional dimension into a pumping enclosure where the pressure therein is higher in said pumping enclosure but nevertheless a vacuum exists sufficient that the mean free path of said background gas molecules is significantly greater than the cross-sectional dimension of said aperture, said aperture being placed and being of such area so as to allow free passage of the bulk of the molecular beam whilst at the same time being sufficiently small that, notwithstanding the pressure being higher in the pumping enclosure than in the analyser enclosure, the mass flow rate of gas backstreaming from said pumping enclosure to said analyser enclosure through the aperture is substantially less than the mass flow rate of the portion of the molecular beam passed through said aperture in the direction opposite to the direction of flow of backstreaming gas.

21. The method of claim 20, wherein said sample molecules are partially ionised by atmospheric pressure ionisation prior to passing through said aperture.

22. The method of claim 20, wherein the sample is at first supplied to a first enclosure at low pressure and wherein said sample molecular flowing into the first enclosure occurs as a supersonic expansion, said molecular beam being formed by an aperture positioned within said supersonic expansion.

23. The method of claim 20, wherein said molecular beam is formed by passing said sample molecules through a tube of predetermined length and diameter, said length of said tube being much greater than its diameter, said diameter being smaller than the mean free path of said sample molecules in said tube.

24. The method of claim 23, wherein said sample molecules are partially ionised by atmospheric pressure ionisation prior to passing through said tube.

25. The method of claim 24, wherein ions are extracted from said molecular beam within said analyser enclosure.

26. The method of claim 20, wherein said molecular beam is ionised within said analyser enclosure.

27. The method of claim 26, wherein ions are extracted from said molecular beam within said analyser enclosure.

* * * * *